United States Patent [19]

Rudick

[11] Patent Number: 4,671,070

[45] Date of Patent: Jun. 9, 1987

[54] MICROGRAVITY BEVERAGE CAN COOLER

[75] Inventor: Arthur G. Rudick, Marietta, Ga.

[73] Assignee: The Coca-Cola Company, Atlanta, Ga.

[21] Appl. No.: 788,879

[22] Filed: Oct. 18, 1985

[51] Int. Cl.[4] ..... F25B 21/02

[52] U.S. Cl. ..... 62/3; 62/371; 62/457

[58] Field of Search ..... 62/371, 372, 457, 529, 62/530, 3

[56] References Cited

U.S. PATENT DOCUMENTS

| | | | |
|---|---|---|---|
| 3,111,166 | 11/1963 | Munz et al. | 62/3 X |
| 3,234,595 | 2/1966 | Weichselbaum et al. | 62/3 X |
| 3,347,060 | 10/1967 | Barran | 62/457 |
| 3,401,535 | 9/1968 | Palmer | 62/457 |
| 3,410,109 | 11/1968 | Maryland | 62/457 |
| 3,974,658 | 8/1976 | Starrett | 62/60 |
| 4,266,407 | 5/1981 | Gibson | 62/371 |

*Primary Examiner*—Lloyd L. King

*Attorney, Agent, or Firm*—Birch, Stewart, Kolasch & Birch

[57] ABSTRACT

A refrigeration apparatus for cooling containers in the microgravity conditions of outer space comprising a cooler compartment having a cold plate therein which is contoured to the shape of sidewall portions of the cans to be cooled. The cold plate is coated with a complient heat transfer medium such as metal-filled silicone rubber. When the lid of the cooler is closed, the containers are firmly engaged by the complient material, forming a good conductive heat transfer relationship. A thermoelectric generator is disposed in a separate cabinet connected to one end of the cooler and includes thermoelectric elements and a heat sink operatively associated with the cold plate within the cooler. A fan is provided in combination with the thermoelectric generator for drawing air over the heat sink thereof to dissipate heat to the surrounding environment. Suitable temperature controls are provided for turning the fan and thermoelectric elements of the generator on and off, and a safety circuit is provided to protect the device against overcurrent and excessively high temperatures in the heat sink.

19 Claims, 5 Drawing Figures

MICROGRAVITY BEVERAGE CAN COOLER

BACKGROUND OF THE INVENTION

The present invention relates to a compact refrigeration device suitable for cooling beverage containers in the microgravity conditions existing in outer space. More specifically, the present invention relates to a thermoelectric refrigerating unit and an associated cooler housing structure suitable for use upon a space ship for cooling beverage containers.

A premix, carbonated beverage can for use in outer space was recently developed by the assignee of the present invention. This can works extremely well for serving a high-quality beverage under the microgravity conditions of outer space; but a suitable refrigeration device is needed for cooling one or more of these cans in the storage locker onboard a space shuttle.

In the conditions that exist in space shuttles or ships, there are space and power limitations with respect to any refrigeration devices which may be used. Therefore, any such refrigeration device must be compact and have low power requirements. Furthermore, since there is no convection in outer space, heat must be removed from the containers to be cooled by conductive heat transfer. Accordingly, a need in the art exists for a compact, low-power refrigeration device which can cool one or more beverage cans in the microgravity conditions of outer space primarily by means of conductive heat transfer.

SUMMARY OF THE INVENTION

Accordingly, it is a primary object of the present invention to provide a refrigeration device for use in outer space which can efficiently cool one or more beverage containers primarily by means of conductive heat transfer.

It is a further object of the present invention to provide a refrigeration device structure which is extremely compact and may be readily placed in a storage locker aboard a space shuttle or ship.

It is another object of the present invention to provide a refrigeration generator for the refrigeration device which is very compact and which has low power requirements.

The objects of the present invention are fulfilled by providing a refrigeration apparatus for cooling containers in the microgravity conditions of outer space, comprising: a housing defining a refrigeration compartment for supporting said containers, said housing having an access opening therein for introducing and removing containers from the compartment and a removable lid for opening and closing the access opening; a cold plate within the refrigeration compartment for cooling the containers by conductive heat transfer, the cold plate including a metal plate conformally shaped to the exterior sidewall portions of the containers, the metal plate having a layer of complient heat transfer material thereon for firmly engaging the sidewall portions; and thermoelectric refrigeration means for maintaining the cold plate at a temperature which cools the containers to a desired temperature.

The thermoelectric refrigeration means includes a separate enclosure mounted to the end of the refrigeration compartment housing, a heat sink disposed within the enclosure, at least one thermoelectric element coupled to the heat sink within the enclosure, and a heat transfer coupling between the thermoelectric elements within the enclosure and the cold plate within the refrigeration compartment housing. The enclosure further includes a gas intake opening aligned with the heat sink and a fan for drawing gas through the intake across the heat sink and out of the enclosure to dissipate heat accumulated in the heat sink.

In a first embodiment, the housing defining the refrigeration compartment is fabricated from foam insulating material. In a second embodiment, the housing defining the refrigeration compartment is fabricated from thin metal such as aluminum, and the cans to be cooled and cold plate within the housing are spaced from the sidewalls of the housing to form an envelope of air completely surrounding the cans. Under the conditions which exist in outer space, air acts as a very good insulator in the absence of convective heat transfer.

The present invention also includes a temperature control means for energizing and deenergizing the thermoelectric elements and fan at appropriate temperature levels and a safety circuit precluding damage to the refrigeration device from current faults or excessive temperatures which may develop in the heat sink.

BRIEF DESCRIPTION OF THE DRAWINGS

The objects of the present invention and the attendant advantages thereof will become more readily apparent by reference to the drawings wherein.

DETAILED DESCRIPTION OF PREFERRED EMBODIMENTS

Figure 1:
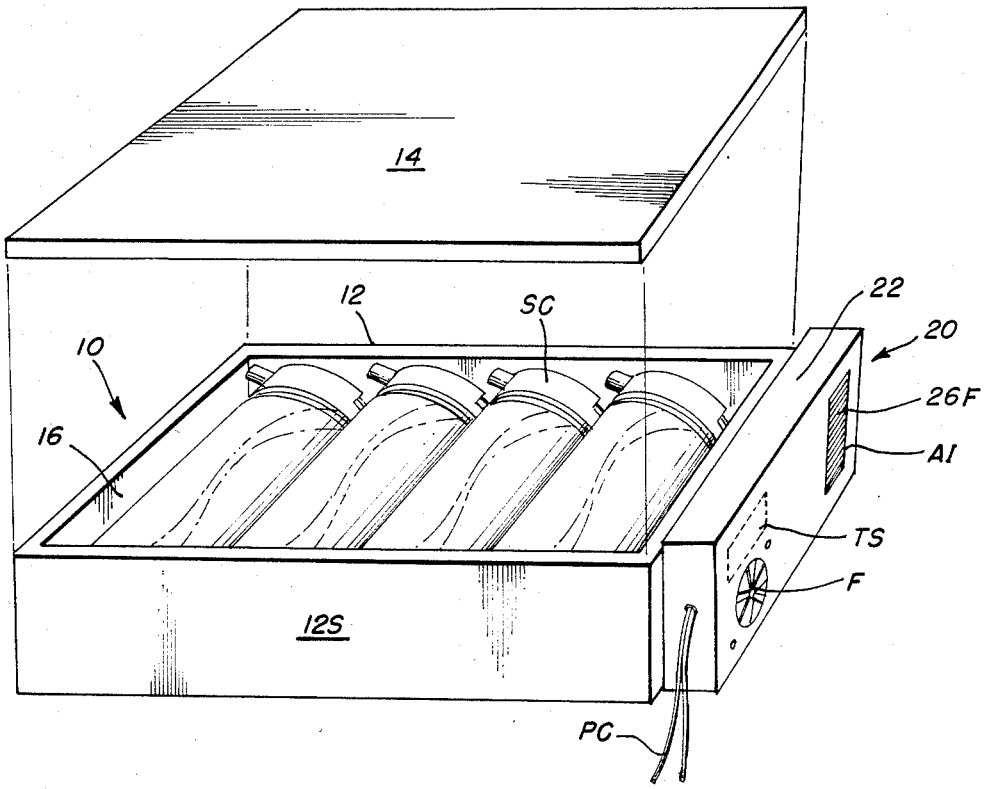
FIG. 1 is an exploded view in perspective showing the refrigeration device of the present invention with a plurality of beverage cans therein.

Referring to FIG. 1, there is illustrated a refrigeration device 10, including a cooler housing with sidewalls 12S, a bottom wall 12B and an access opening 16. Disposed within cooler housing in a refrigeration compartment defined thereby are a plurality of space cans SC of the type disclosed in the aforementioned U.S. patent application Ser. No. 724,155, filed Apr. 17, 1985 and assigned to the same assignee as the present invention. A removable lid 14 is provided which may be secured to the upper edges of sidewalls 12S by any suitable means such as latches, hinges, screws and so forth (not shown). Mounted at one end of the cooler housing 12 is a thermoelectric generator generally indicated 20, including an enclosure 22. Power is provided to the thermoelectric generator 20 through a power cord PC. As illustrated in FIG. 1, a fan F is mounted in an end wall of the enclosure 22 and is operatively associated with an air intake opening AI, and the cooling fins 26F of a heat sink, in a manner to be more fully described hereinafter with reference to FIGS. 2 and 3. Also illustrated in phantom in FIG. 1 is the location of a temperature switch device TS which is the main control device of the temperture control circuit of FIG. 5, to be described hereinafter.

Figure 2:
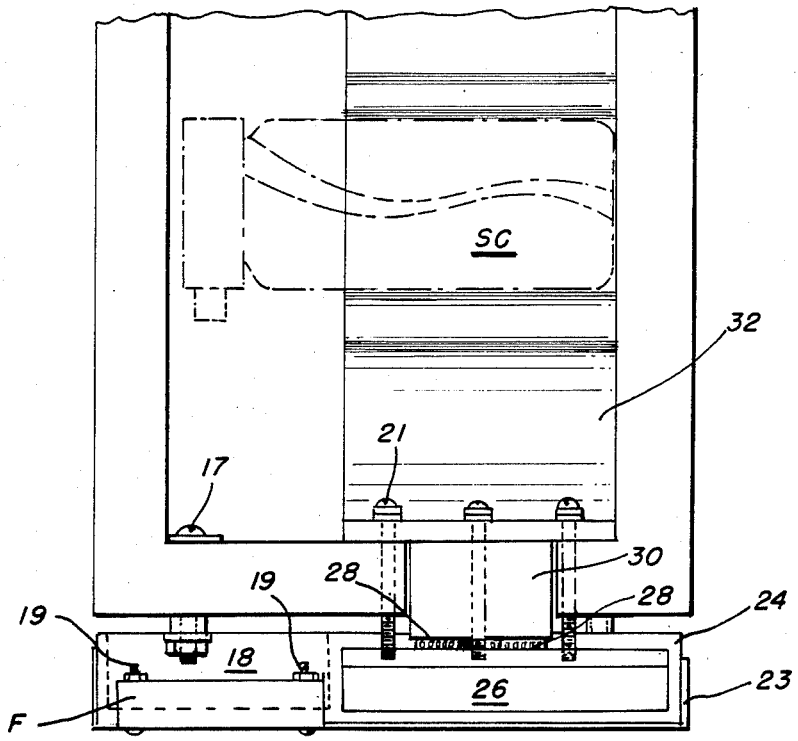
FIG. 2 is a top plan view of the refrigeration device of FIG. 1 partially in section.

Referring to the top plan view in FIG. 2 of the refrigeration device of FIG. 1, the details of the thermoelectric generator 20 are illustrated. Thermoelectric generator 20 includes a heat sink 26, with cooling fins 26F, a thermoelectric element or elements 28, a heat transfer block 30 and a cold plate 32. The heat sink 26 is mounted within enclosure 22 on a mounting plate 24 by means of bolts 21 extending through one sidewall 12S of housing 12. A fan mounting plate 23 has a rim that fits over the sidewalls of the mounting plate 24 and includes a fan F mounted therein with the suction side of the fan facing a plenum chamber 18 within the enclosure 22. Also provided within the fan mounting plate 23 is an air intake opening AI (FIG. 1) which permits air to be drawn therethrough by the fan F over cooling fins 26F through the plenum 18 and out the fan F. The fan F is mounted to plate 23 by bolts 19 and the heat sink mounting plate 24 is bolted to a sidewall 12S of housing 12 by bolts 17.

Thermoelectric elements 28 may be of any commercially available type and are provided on the rear side of heat sink 26, and a front face of a heat transfer block 30. Heat transfer block 30 is, in turn, coupled to cold plate 32.

Figure 3:
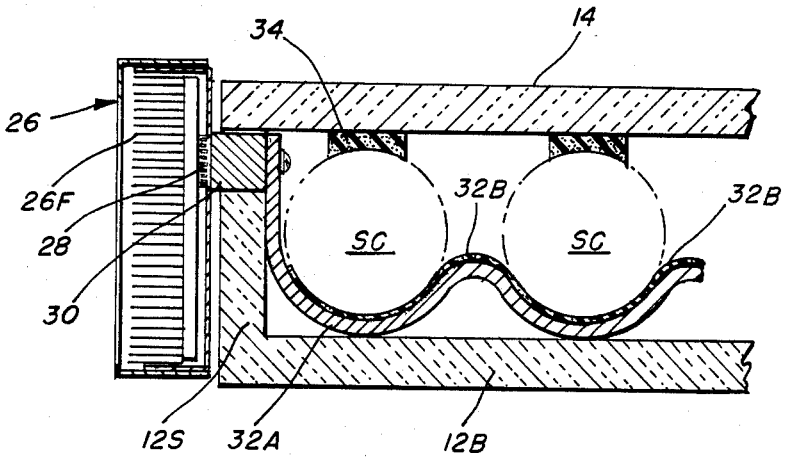
FIG. 3 is a sectional view taken along line A—A of FIG. 2.

Since there is no convective heat transfer in outer space, the cold plate 32 of the present invention is designed to provide very efficient conductive heat transfer with sidewall portions of the cans SC. In order to achieve this highly efficient conductive heat transfer, cold plate 32 includes a metal layer 32A conformally shaped to sidewall portions of the cans SC, as best illustrated in FIG. 3, and a thin layer 32B of complient heat transfer material, such as a metal filled silicone rubber, on the metal layer 32A adjacent to the sidewall portions of the associated cans SC. Cold plate 32 rests upon a bottom wall 12B of housing 12, and the inner surface of removable lid 14 is provided with a foam pad opposite each can SC to firmly bias the cans SC against complient material 32B when lid 14 is fully closed. That is, the cans SC are tightly squeezed between the foam pads 34 and complient material 32B when lid 14 is fully closed, and the refrigeration compartment within housing 12 is sealed.

In the embodiment illustrated in FIG. 3, the walls of the housing 12 are fabricated from foam insulating material. However, in an alternative embodiment illustrated in FIG. 4, the walls of housing 12 may be thin metal such as aluminum.

Figure 4:
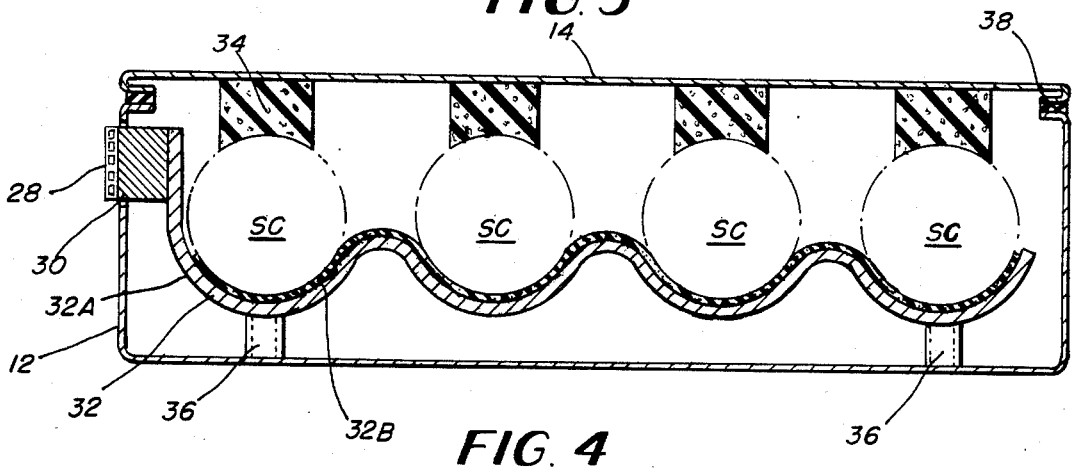
FIG. 4 is a side elevational view in section of a second embodiment of a refrigeration compartment of the present invention which is an alternative embodiment to the structure illustrated in FIG. 3.

Referring to FIG. 4 wherein the walls of housing 12 are thin aluminum, adequate insulation is provided by spacing the cold plate 32 from the sidewalls of housing 12 by rubber mounts 36. As illustrated, the cans SC are almost completely surrounded by an air space which, in the absence of convection, makes an excel lent insulator. Accordingly, in the conditions that exist in a space shuttle, the housing structure embodiment of FIG. 4 provides efficient cooling of the cans SC. All other parts in FIG. 4 are similar to those in FIG. 3 with the exception of the additional foam gasket between the upper edges of the sidewalls of the housing 12 and the bottom peripheral edge of the lid 14. This gasket would be desirable in this embodiment to maintain a sealed air space.

Figure 5:
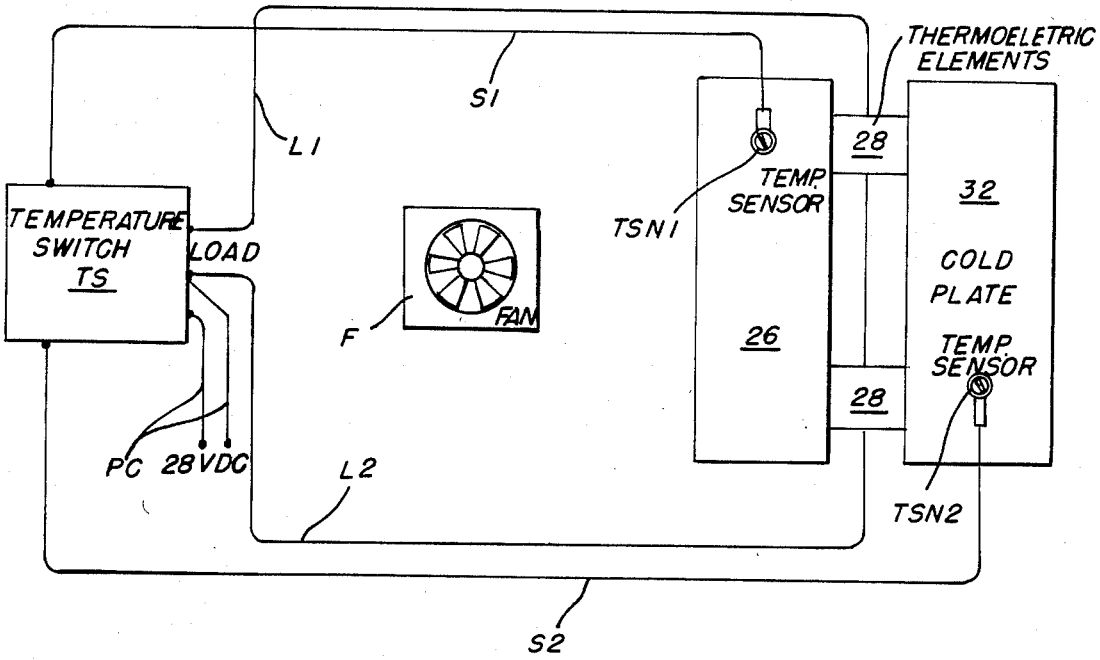
FIG. 5 is a schematic diagram of a temperature control circuit for the refrigeration device of the present invention.

Referring to FIG. 5, there is illustrated a circuit schematic of the temperature control and power supply system for the refrigeration device of the present invention. The heart of this system is a temperature switch or controller TS which is coupled through load lines L1, L2 to a fan F and the thermoelectric elements 28. As illustrated, the fan F and thermoelelectric elements 28 are connected in parallel so that they are turned on and off together. The temperature switch TS also is connected through a pair of temperature sensor lines S1 and S2 to a first temperature sensor TSN1 in heat sink 26, and a second temperture sensor TSN2 in cold plate 32, respectively. Power is supplied to the system through a power cord PC and the temperature switch TS. In the preferred embodiment, the power supplied is 28 volts DC which is readily available within a space shuttle or ship.

The temperature switch TS controls the temperature of the cold plate 32 and prevents the heat sink 26 from overheating. Temperature switch TS also includes over-current means for protecting the cooler's electrical system. In a typical operating situation, the temperature switch TS would turn the thermoelectric elements 28 and the fan F on when the cold plate 32 exceeds 37 F. and off when the cold plate 32 drops below 35 F. If the current in the system exceeds 5 amps or the heat sink temperature exceeds 200 F., the switch TS will disconnect the power supply from the system to preclude any damage.

It should be understood that although the preferred embodiment of the refrigeration means of the present invention includes a thermoelectric generator, other forms of refrigeration devices could be utilized to cool the novel cold plate structure of the pressent invention. Although a typical mechanical refrigeration system, including a condensor, compressor and evaporator coil, would be larger than normally desired, it could be utilized to cool the cold plate 32 of the present invention by placing the evaporator coil thereof in direct thermal contact therewith. It is also possible to use some form of chemical refrigeration device in combination with the cold plate of the present invention, such as a device which would cool by means of an exothermic reaction. However, the thermoelectric generator is the preferred embodiment because of its compact structure and low electrical energy requirements.

It should be understood that the refrigeration device described herein may be modified as would occur to one of ordinary skill in the art without departing from the spirit and scope of the present invention.

What is claimed is:

1. A refrigeration apparatus for cooling containers in the microgravity conditions of outer space comprising:

(a) a housing defining a refrigeration compartment for supporting said containers, said housing having an access opening therein for introducing and removing containers from said compartment and a removable lid for opening and closing said access opening;

(b) cold plate means within said refrigeration compartment for cooling said containers by conduction, said cold plate means including a metal plate conformally shaped to exterior sidewall portions of said containers, said metal plate having a layer of complient heat transfer material thereon for firmly engaging said sidewall portions; and (c) refrigeration means for maintaining said cold plate at a temperature which cools said containers.

2. The refrigeration apparatus of claim 1, further including means on said lid for biasing said containers into firm engagement with said complient material.

3. The refrigeration apparatus of claim 2 wherein said means for biasing comprises foam pads on an interior surface of said lid.

4. The refrigeration apparatus of claim 1, wherein said complient material comprises metal filled silicone rubber.

5. The refrigeration apparatus of claim 1 wherein said housing is fabricated from foamed plastic.

6. The refrigeration apparatus of claim 1 wherein said housing is fabricated from thin metal.

7. The refrigeration apparatus of claim 6 wherein said cold plate means is supported in said housing on a sidewall thereof opposite said access opening by resilient spacers extending from said sidewall.

8. A refrigeration apparatus for cooling containers in the microgravity conditions of outer space comprising:

a housing defining a refrigeration compartment for supporting said containers, said housing having an access opening therein for introducing and removing containers from said compartment and a removable lid for opening and closing said access opening;

(b) cold plate means within said refrigeration compartment for cooling said containers by conduction, said cold plate means including a metal plate conformally shaped to exterior sidewall portions of said containers, said metal plate having a layer of complient heat transfer material thereon for firmly engaging said sidewall portions; and (c) thermoelectric refrigeration means for maintaining said cold plate at a temperature which cools said containers.

9. The refrigeration apparatus of claim 8 further including means on said lid for biasing said containers into firm engagement with said complient material.

10. The refrigeration apparatus of claim 9 wherein said means for biasing comprises foam pads on an interior surface of said lid.

11. The refrigeration apparatus of claim 8 wherein said complient material comprises metal filled silicone rubber.

12. The refrigeration apparatus of claim 8 wherein said housing is fabricated from foamed plastic.

13. The refrigeration apparatus of claim 8 wherein said housing is fabricated from thin metal.

14. The refrigeration apparatus of claim 13 wherein said cold plate means is supported in said housing on a sidewall thereof opposite said access opening by resilient spacers extending from said sidewall.

15. The refrigeration apparatus of claim 8 wherein said thermoelectric refrigeration means includes an enclosure mounted on an end of said housing, a heat sink within said enclosure, at least one thermoelectric element coupled to said heat sink in said enclosure, and a heat transfer block coupling said thermoelectric elements to said cold plate in said housing.

16. The refrigeration apparatus of claim 15 further including a gas intake opening in said enclosure aligned with said heat sink and fan means mounted in said enclosure for drawing gas through said gas intake opening, across said heat sink and out of said enclosure.

17. The refrigeration apparatus of claim 16 wherein said heat sink includes a plurality of spaced cooling fins and said fan means draws air through said air intake opening and between said fins.

18. The refrigeration apparatus of claim 16 further including temperature control means for simultaneously engaging said fan means and said at least one thermoelectric element when the temperature of said cold plate exceeds a predetermined level, and de-energizing said fan means and thermoelectric element when said temperature drops below a predetermined level.

19. The refrigeration apparatus of claim 18 wherein said temperature control means further includes safety circuit means for disconnecting the supply of power to the thermoelectric elements and said fan means if the current to said elements exceeds a predetermined limit or the temperature of said heat sink exceeds a predetermined limit.

* * * * *